United States Patent [19]

Shimakata et al.

[11] 4,265,102

[45] May 5, 1981

[54] METHOD FOR MOLDING A BULGE

[75] Inventors: Ryuji Shimakata, Atsugi; Kazuyoshi Naito, Machida, both of Japan

[73] Assignee: Tokyo Press & Die Co., Ltd., Tokyo, Japan

[21] Appl. No.: 971,259

[22] Filed: Dec. 20, 1978

[30] Foreign Application Priority Data

Dec. 27, 1977 [JP] Japan ..... 52-159247

[51] Int. Cl.[3] ..... B21D 26/02

[52] U.S. Cl. ..... 72/58; 72/62; 29/421 R; 264/534; 264/570

[58] Field of Search ..... 72/58, 57, 61, 60, 62; 29/421 R; 264/531, 534, 570

[56] References Cited

U.S. PATENT DOCUMENTS

| | | | |
|---|---|---|---|
| 2,592,867 | 4/1952 | Cuq | 72/58 |
| 2,688,297 | 9/1954 | Livermont et al. | 72/58 |
| 3,335,590 | 8/1967 | Early | 29/421 R |
| 3,443,409 | 5/1969 | Matsukin | 72/62 |
| 3,858,422 | 1/1975 | Tominaga et al. | 29/421 R |

*Primary Examiner*—Daniel C. Crane

*Attorney, Agent, or Firm*—Bacon & Thomas

[57] ABSTRACT

A method for molding a bulge comprises a step of jetting a pressure fluid from a nozzle into a shaped blank fitted thereto thereby causing air trapped in the shaped blank to be agitated into air bubbles to allow the fluid pressure to be applied onto the inner surface of the shaped blank during discharging the liquid from within the blank.

5 Claims, 11 Drawing Figures

METHOD FOR MOLDING A BULGE

BACKGROUND OF THE INVENTION

This invention relates to a method for molding a bulge which may eliminate a step for removing air from within a bulge to be molded before molding.

In such a conventional method a cylindrical blank is disposed in a mold of desired shape and a high-speed flow of liquid produced by an impact fluid pressure is jetted into the blank, thereby obtaining a desired shape (Japanese patent publication 23935/1974). Since this method is not required to remove air from within the article before molding, the manufacturing step is simpler and the molding time can be much reduced, thus making is suitable for mass production. Air, if not removed, is locally compressed by such jet flow of pressure liquid and pressure is not sufficiently transmitted thereto, resulting in local deformation of the article. This method can remove such drawback. However, this method requires an exclusive impact liquid pressure generator. Such generator is bulkier and expensive and thus molding apparatus is bulkier as a whole and costly. Furthermore, the blank, if molded under such a momentary high impact pressure, suffers an excessive strain, resulting in a poor yield. For this reason, only a simple form of article can be manufactured. Such conventional method requires a guide for causing a hiighspeed jet flow of pressure fluid to effectively impinge onto the inner surface of the blank and it also requires a complicated nozzle shape. Since, in this case, the guide must be placed in the mold, the shape of an article to be molded is restricted.

It is accordingly an object of this invention to provide a method for manufacturing a bulge which can save the time of beforehand removing air from within a blank to be molded and which can manufacture a bulge, simple or complicated in design, using small-sized, low-cost apparatus.

BRIEF DESCRIPTION OF THE DRAWINGS

This invention will be further explained by way of example by referring to the accompanying drawing in which.

PREFERRED EMBODIMENT OF THE INVENTION

One aspect of this invention will be explained below by referring to the accompanying drawings.

Figure 1:
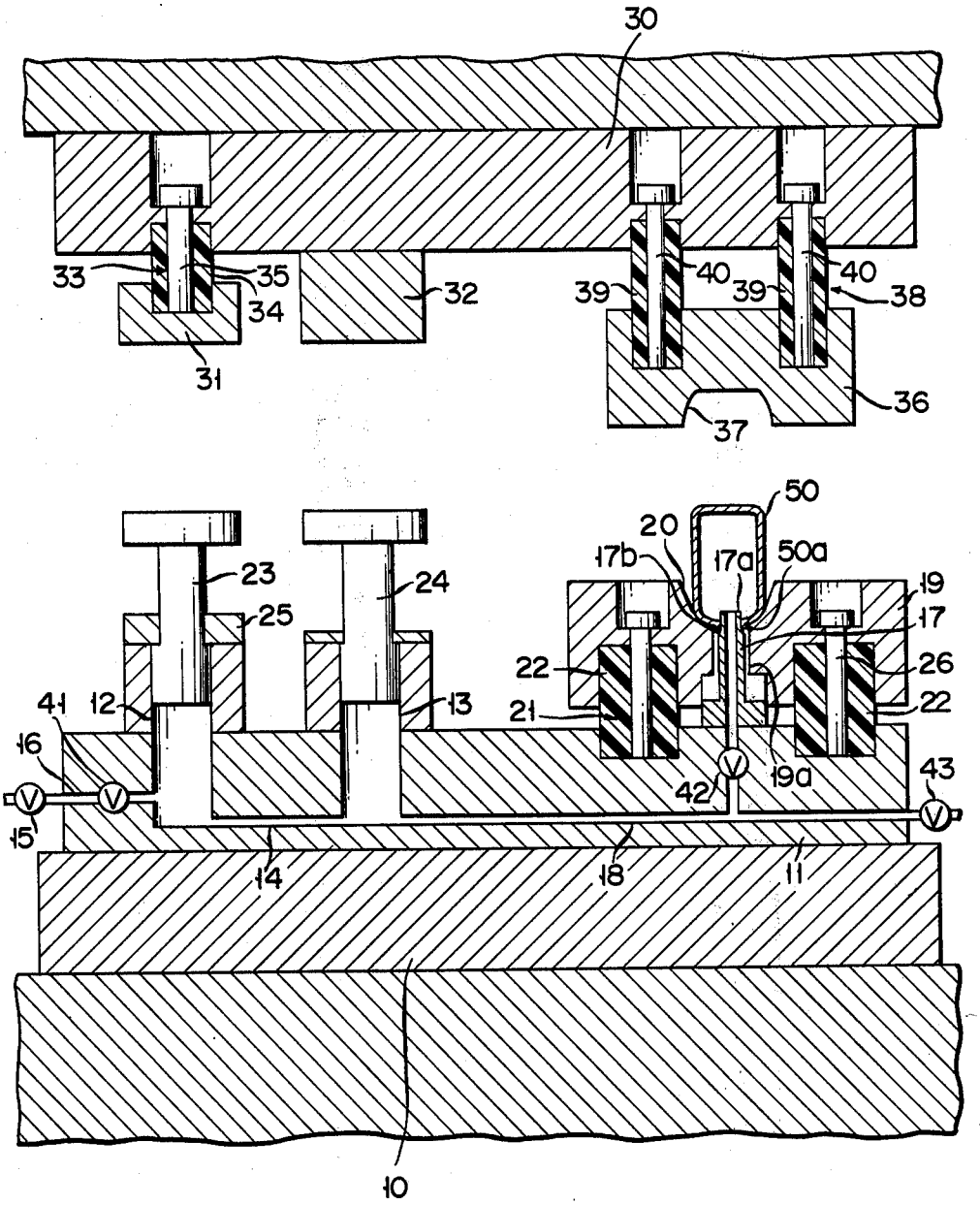
FIG. 1 is a cross-sectional view schematically showing apparatus for molding a bulge as a whole.

FIG. 1 generally shows molding apparatus. Reference numeral 10 shows a lower fixed plate on which is disposed a thick-boardlike manifold 11. First and second cylinders 12 and 13 are juxtaposedly formed in the upper surface of the manifold 11. The cylinders 12 and 13 have the same capacity and are in communication with a pipe 14. The first cylinder 12 is connected by a pipe 16 to a water supply device (not shown) through a water supply cock 15. The second cylinder 13 is connected by a pipe 18 to a high pressure nozzle 17. A first piston 23 is vertically reciprocably movable in the first cylinder 12 and a second piston 24 in the second cylinder 13. A stop 25 is provided between a piston head of the first piston 23 and the top surface of the first cylinder 12 so that the first piston 23 is made shorter in stroke than the second piston 24. A suitable means (not shown) such as a compression spring is provided in the respective pistons 23 and 24. The nozzle 17 has a stepped portion **17*b* having a tapered surface and a neck portion (forward end portion) immediately adhead of the stepped portion 17*b*. A lower mold half 19 is connected to the manifold 11 such that it can be vertically moved against the manifold 11. A vertically penetrating bore 19*a* is provided in the center portion of the lower mold half 19 and the nozzle 17 is inserted through the bore 19*a* in the lower mold half 19. A substantially semi-spherical cavity 20 is provided in the upper surface of the lower mold half 19 such that the lower central portion thereof communicates with the vertical bore 19*a* in the lower mold half 19. The upper end of the nozzle 17 extends out into the cavity 20. A support mechanism 21 is mounted between the manifold 11 and the lower mold half 19 such that the lower mold half 19 is elastically supported. When a depressing force exerted upon the lower mold half 19 exceeds a predetermined force, the support mechanism 21 permits the lower mold half 19 to be further moved downward. In this embodiment, the support mechanism 21 comprises four elastic members 22 made of urethane rubber and arranged at four locations with the nozzle 17 as a center and four suspension bolts 26 each penetrated through the center portion of the corresponding elastic member 22 with a head thereof loosely fitted in a corresponding recess in the upper surface of the lower mold half 19**.

An upper mold half fixing plate 30 is mounted on a ram such that it confronts the manifold 11. The fixing plate 30 is disposed above the manifold 11. First and second pushers 31 and 32 are attached to the lower surface of the fixing plate 30 in position to confront the first and second pistons 23 and 24, respectively. When the plate 30 is vertically moved, the pushers 31 and 32 are moved together with the plate 30. The first pusher 31 is elastically supported by a support mechanism 33 such that when the piston 23 is lowered and attains a predetermined stroke, it is not moved further downward during further lowering of the plate 30. The support mechanism 33 comprises an elastic member 34 made of urethane rubber and attached between the plate 30 and the pusher 31 and a suspension bolt 35 loosely vertically fitted in the plate 30 with a head thereof located in a recess in the upper surface of the plate. The lower portion of the suspension bolt 35 extends through the center portion of the elastic member 34, and the second pusher 32 is attached to the plate 30 and moved vertically at the same stroke as that of the plate 30.

An upper mold half 36 is attached to the lower surface of the plate 30 such that it faces the lower mold half 19. A cavity 37 in the lower surface of the upper mold 36 is mated with the cavity 20 of the lower mold half 19 to define an outward shape of a bulge to be molded. A support mechanism 38 is provided between the plate 30 and the upper mold half 36 such that it elastically supports the upper mold half 36. That is, the support mechanism 38 is such that, even if a pressure exceeding a predetermined value is exerted onto the upper mold half, the lowering of the plate 30 is stopped irrespective of its further lowering force. The support mechanism 38 comprises four elastic members 39 made of urethane rubber and attached between the plate 30 and the upper mold half 36 and suspension bolts 40 each vertically inserted through the center portion of the elastic member 39 and slidably suspended from the plate 30.

In FIG. 1, reference numerals 41 and 42 show first and second check valves and 43 shows a relief valve. These valves are all provided in the manifold 11. The first check valve 41 is attached to the pipe 16 on the water supply side of the first cylinder 12 and the second check valve 42 is attached to the pipe 18 on the side of the manifold 11 where a pressure fluid is supplied to the nozzle 17. The relief valve 43 is attached to the pipe 18 so that a jet flow of pressure liquid from the nozzle 17 does not exceed a predetermined value.

The check valves 41 and 42 prevent a reverse flow of liquid in the manifold 11 and also prevent the liquid from being constantly jetted from the nozzle 17 by a pressure liquid (a predetermined pressure) from the liquid supply device. In order to attain such an object it is necessary that the following relation be established:

$$P_1 < P < P_2$$

where P denotes the pressure of liquid from the fluid supply device and $P_1$ and $P_2$ denote the cracking pressures of the first and second check valves 41 and 42.

Figure 4:
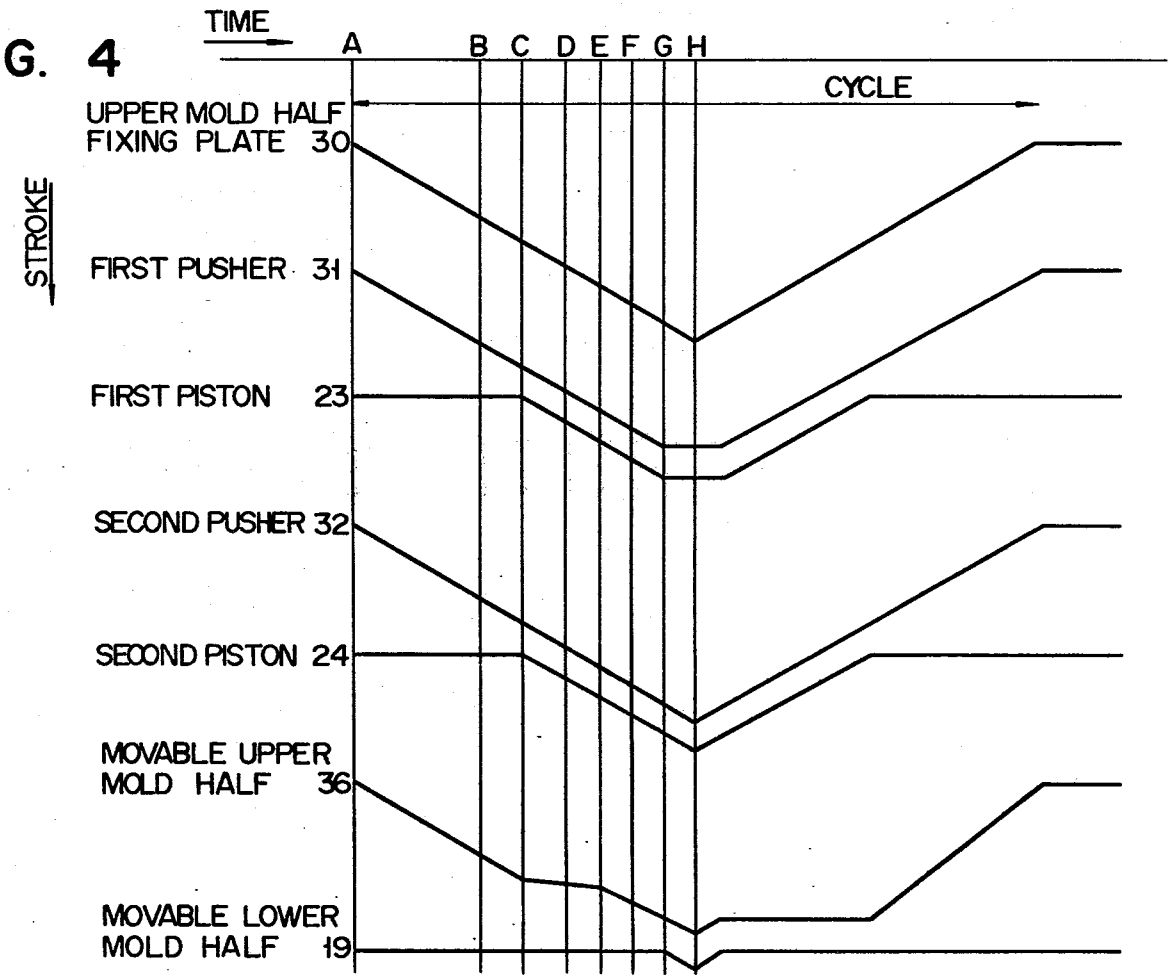
FIG. 4 shows a flow chart of each associated element during a manufacturing process.

A method using molding apparatus will be explained below according to the work process of each element as shown in FIG. 4.

Firstly, the plate 30 is brought to the uppermost position as shown in FIG. 1. A shaped blank 50 made of metal such as brass is placed in the cavity 20 of the lower mold 19. At this time, a neck portion 50*a* of the blank 50 is fitted over the neck portion 17*a* of the nozzle 17 such that the end of the neck portion 50*a* is located adjacent the stepped portion 17*b* of the nozzle 17 with a clearance left between the outer surface of the neck portion 50*a* of the blank 50 and the inner surface of the bore 19*a* of the lower mold half 19.

Since the plate 30 is at the uppermost position, the first and second pistons 23 and 24 are maintained at the uppermost position such that their upper end surfaces are in the same plane. The lower end surfaces of the first and second pushers 31, 32 are also located in the same plane.

Figure 3A:
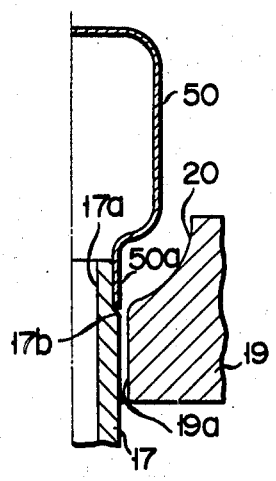
FIGS. 3A to 3H are explanatory views showing a sequence of steps.
Figure 3B:
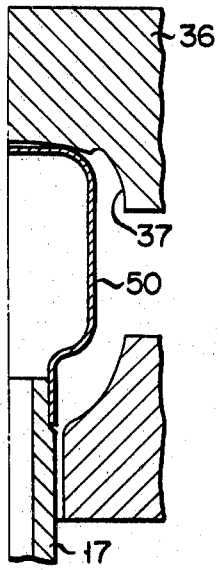
Figure 3C:
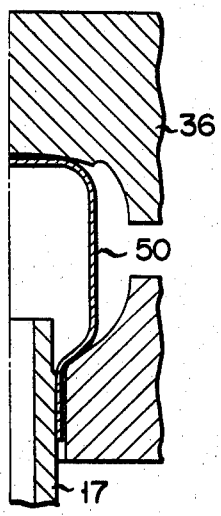

In this state, the support mechanisms 21, 33 and 38 are in the relaxed state. The plate 30 is lowered at time A in FIG. 4 and, when the time B in FIG. 4 is reached, the cavity 37 of the upper mold half 36 comes into contact with the upper surface of the blank 50 as shown in FIG. 3B. The plate 30 is further lowered and when the time C in FIG. 4 is reached the first and second pushers 31 and 32 are abutted against the corresponding pistons 23 and 24. As shown in FIG. 3C the upper mold half 36 is further lowered together with the plate 30 to cause the neck portion 50*a* of the shaped blank 50 to be pushed down along the stepped portion 17*b* of the nozzle 17 to permit the blank 50 to be hermetically sealed on the nozzle 17.

Figure 3D:
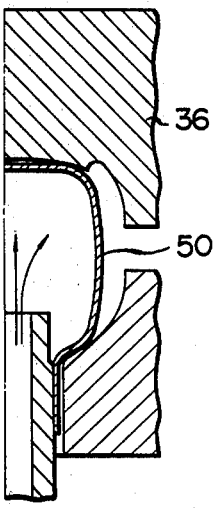
Figure 3E:
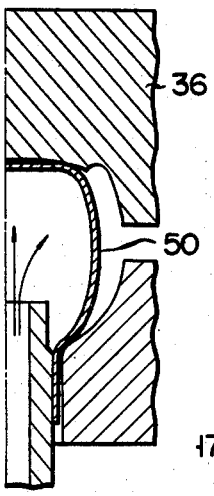

With further lowering of the plate 30 the pistons 23 and 24 are depressed by the corresponding pushers 31 and 32 and a pressure liquid is supplied through the cylinders 12 and 13 to the nozzle 17. The pressure liquid is jetted from the nozzle 17 into the blank 50. When the times D and E are reached during the lowering movement of the plate, the blank 50 starts to be deformed, as shown in FIGS. 3D and 3E, under supply of the liquid pressure. During the C-E time period the upper mold half 36 is maintained substantially in the same level, through somewhat lowered. The reason for this is as follows: The upper mold half 36 is lowered to the extent that the blank is deformed, and a further lowering force is absorbed by the support mechanism 38 i.e. by the compression of the elastic members in the support mechanism 38.

Figure 3F:
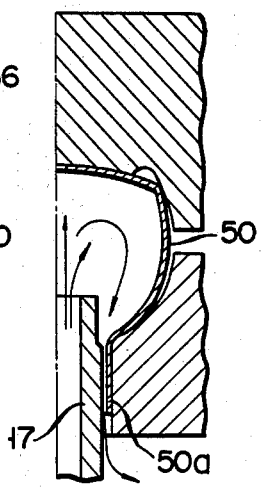

When a pressure in the blank 50 reaches a predetermined level by a jet flow of pressure liquid, the inner surface of the neck portion 50*a* of the blank 50 is moved, as shown in FIG. 3F, away from the outer surface of the nozzle 17, thereby breaking a hermetic sealing of the blank 50. At this time, the plate 30 reaches the position indicated by the time F in FIG. 4. After the time E, the downward movement of the upper mold half 36 is restarted such that during the downward movement of the plate 30 the blank 50 is molded under the jet flow of pressure liquid.

When the time G in FIG. 4 is reached, the downward movement of the first piston 23 alone is stopped. Thereafter, even if the plate 30 is lowered, the "stopped" state is maintained by the compression of the elastic member 34 in the support mechanism 33.

Figure 3G:
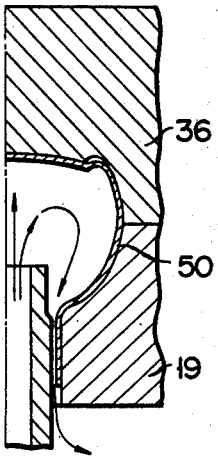

Thereafter, a liquid pressure from the second cylinder 13 is supplied and the jet flow of pressure liquid from the nozzle 17 becomes substantially halved. At time G in FIG. 4, the upper mold half 36 is abutted against the lower mold half 19 as shown in FIG. 3G and a greater part (for example 95%) of molding process is finished.

Figure 3H:
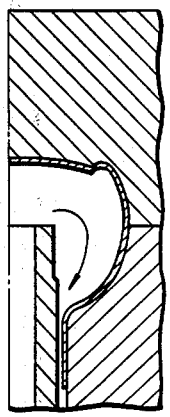

Thereafter, the lower mold half 19, together with the upper mold half 36, is moved downward against an elastic force of the elastic member 22 of the support mechanism 21. At time H in FIG. 4 the downward movement of these mold halves 19 and 36 is stopped, thus completing a molding operation. At the time, the blank 50 is completely molded into a desired container with every detail thereof formed as shown in FIG. 3H.

Figure 2:
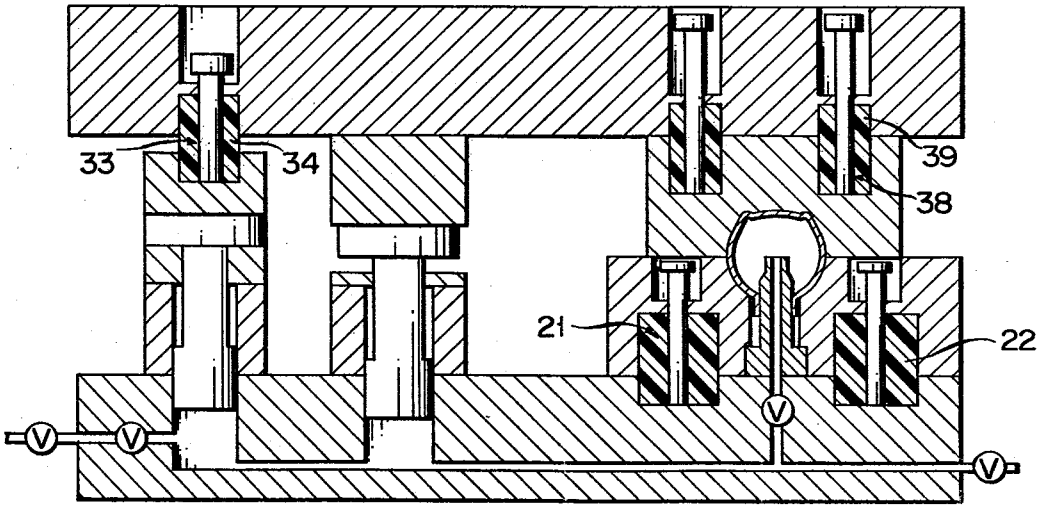
FIG. 2 is a view, similar to that of FIG. 1, showing a final molding step.

FIG. 2 shows the state of the apparatus when a shaped blank is molded into a final desired configuration. In the lowest position of the plate 30 as shown in FIG. 2 the elastic members 22, 34 and 39 of the support mechanisms 21, 33 and 38, respectively, are in the "most compressed" state.

A molded container or bulge removing process is effected in the reverse way.

When a desired article is completely formed, a supply of the jet flow of pressure liquid is stopped, air is separated from the pressure liquid in the formed container, thereby providing an upward pressure. With the upward movement of the upper mold half 36 the shaped container is removed away from the lower mold half 19 such that it is held, under the above-mentioned upward pressure, in the cavity 37 of the upper mold half 36. As a result, the molded container can be easily removed away from the lower mold half 19.

The way the container is molded under the jet flow of pressure liquid will now be explained below.

When the pistons 23 and 24 depressed after lapse of the time C in FIG. 4 the pressure liquid is jetted from the nozzle 17 into the shaped blank 50. The pressure liquid causes air in the blank 50 to be agitated into air bubbles while being diffused. The air bubbles diffused through the liquid with a raise in internal pressure is further reduced to finer bubbles to the extent that a local air-cushion effect can be ignored, thereby obtaining a uniform diffusion of fine air bubbles. Since the diffused air bubbles are compressed by a jet flow of pressure liquid, the internal pressure is increased at the first stage and it is further increased at the second stage so that it is in balance with the blank strength. At this time, the blank suffers a change by the above-mentioned internal pressure and downward pressure so that its inner volume is somewhat increased. When at the third stage the pressure reaches a seal strength, sealing is broken to permit an outflow of pressure liquid. At the fourth stage the internal pressure in the blank is further increased and a predetermined pressure is maintained. At this time the internal pressure is mainly determined by (1) the strength of the blank,
(2) the seal strength determined by the material of which the blank is made,
(3) a clearance determined by the lower mold half, nozzle and thickness of the blank,
(4) a jet flow of pressure fluid determined by the ram speed and piston diameter, and
(5) an accuracy in the inner diameter of the nozzle, the surface roughness of the inner surface of the nozzle and pattern of the pressure liquid.

The blank is molded by cooperation of the internal pressure and the external pressure from the upper mold 36. When at the third stage the internal pressure reaches a predetermined level a clearance is created, as shown in FIG. 3F, between the nozzle 17 and the neck portion 50*a* of the blank. A jet flow of pressure liquid leaks out from within the blank. Since at this time a supply of the jet flow of pressure liquid is continued, the internal pressure in the blank is maintained at a constant level. When a greater part of molding process is finished, pressure application by the first cylinder 12 is stopped and the molding of the blank is finished under a smaller amount of pressure liquid from the second cylinder.

In the method of this invention the article is molded with air trapped therein, while supplying a jet flow of pressure liquid into the article. An air venting process can be omitted. During the molding operation, air in the molded container is intimately mixed with the pressure liquid jetted from the nozzle into the article to provide air bubbles. The air bubbles are reduced to finer air bubbles to the extent that air cushion effect can be ignored. Thus, a uniform pressure is distributed over the inner surface of the container. As a result, a container complicated in shape can be obtained in good yield. This effect is further enhanced, since when the interior of the container reaches a predetermined pressure the pressure fluid is discharged out from within the container to permit the fluid pressure in the container to be maintained at substantially constant level, while supplying the jet flow of pressure liquid. The "constant level" defined herein means not that the fluid pressure in the container is maintained accurately at constant level, but that the fluid pressure may be somewhat changed i.e. no abrupt, great pressure is invloved. The jet flow of pressure fluid from the nozzle, as well as the outflow of the pressure fluid through the clearance between the nozzle and the neck portion of the article, may be adjusted to permit the pressure in the container to be varied even after the discharge of the pressure liquid is started. The pressure liquid can be discharged not only by an automatic leaking operation as in the above-mentioned example, but also by effecting a manual or mechanical discharging operation after, for example, a predetermined time (In this case, the discharging area is not restricted to the neck portion of the article). A single jet liquid flow pattern or a multiple jet liquid flow pattern may be used when the pressure liquid is supplied from the nozzle to the interior of the article. A liquid discharge may be effected before a predetermined liquid pressure is reached (for example, from the very start of the water jet operation).

Since in the method of this invention any exclusive impact providing device is unnecessary, the apparatus used can be made compact and low in cost.

Although two piston-cylinder combinations are used in the method of this invention, only a single piston may be used. It is needless to say that three or more piston-cylinder combinations may be used. In this case, some or all the pistons may have the same stroke. It is not necessary that the cylinders have the same volume. If a piston-cylinder combination having a smaller volume is used as, for example, one which is operated until the last moment, a pressure involved immediately before a molded container is obtained can be accurately controlled.

Although the molded container has been explained as having a substantially spherical configuration, if any suitable cavity shape is selected, any form of article such as a hollow article can be formed. In the above-mentioned example, the upper and lower mold halves are both of movable type. Alternatively, one of the upper and lower mold halves may be of stationary type and in this case the other is of movable type. The mold halves may be of horizontal type so that they are moved horizontally relative to each other.

Although a combination of suspension bolt and urethane rubber is used as an elastic support mechanism, any suitable means such as a piston-cylinder assembly may be used if only it can absorbe the movement of members which are supported under more than a predetermined pressure. The jet liquid may be water, oil etc.

In the above-mentioned method sealing is effected between the nozzle and the article by causing the upper mold half to be lowered to permit the neck portion of the article 50 to be moved down into intimate contact with the stepped portion 17*b* of the nozzle which is located immediately next to the neck portion 17*a* (forward portion) of the nozzle. However, a non-stepped nozzle can be used. In this case, when the article 50 is depressed by the upper mold half the neck portion of the article 50 is partially inwardly bent into close contact with the outer surface of the nozzle, thereby attaining sealing between the nozzle and the article.

What we claim is:

1. A method for molding a bulge from a shaped blank having a neck portion and an entirely unoccupied interior comprising the steps of inserting a nozzle into the shaped blank through the neck portion to seal the neck portion to the nozzle, and jetting a pressure liquid from the nozzle into the entirely unoccupied interior of the shaped blank to cause air trapped in the shaped blank to be agitated into air bubbles to allow the liquid pressure to be applied to the inner surface of the shaped blank with a uniform distribution to mold a bulge, and controlling the pressure in the shaped blank by discharging, during molding, the liquid from within the blank through an interspace between the nozzle and neck portion by breaking the seal at the neck portion of the shaped blank.

2. The method according to claim 1 in which said step of discharging further comprises applying pressure by a mold onto the outer surface of the shaped blank to mold a bulge while supplying a jet flow of pressure liquid.

3. A method for molding a bulge according to claim 1 wherein said shaped blank is of substantially bulb-shape.

4. The method according to claim 3 in which said step of discharging comprises applying pressure by a mold onto the outer surface of the shaped blank to mold a bulge while jetting said pressure liquid into said shaped blank.

5. The method according to claims 1, 2, 3 or 4 in which a flow of pressure liquid jetted into the shaped blank and a discharge flow of the pressure liquid from within the shaped blank are selected to be constant.

* * * * *